United States Patent [19]

Gold

[11] Patent Number: 4,680,996

[45] Date of Patent: Jul. 21, 1987

[54] SCREWDRIVER

[76] Inventor: Peter N. Gold, 465 N. Wood Rd., Rockville Centre, N.Y. 11570

[21] Appl. No.: 853,437

[22] Filed: Apr. 18, 1986

[51] Int. Cl.[4] ..... B25B 23/10

[52] U.S. Cl. ..... 81/456; 81/436; 7/108; 140/149

[58] Field of Search ..... 81/456, 451, 452, 436, 81/125, 52, 9.4; 7/107, 108; 140/117, 118, 123, 149

[56] References Cited

U.S. PATENT DOCUMENTS 942,742 12/1909 Presson ..... 81/452

2,501,217 3/1950 Hawn ..... 81/DIG. 8

2,632,488 3/1953 Becker ..... 81/452

3,095,912 7/1963 Sullivan ..... 7/108

*Primary Examiner*—Frederick R. Schmidt

*Assistant Examiner*—Bradley I. Vaught

*Attorney, Agent, or Firm*—Myron Amer

[57] ABSTRACT

A screwdriver having its blade end rotated slightly about its longitudinal axis and also provided with arcuate cutouts at the rotation, so that the combination of these two structural features provides an aligning edge that remains in the observation of the user and facilitates placement of the screw-turning edge in the slot of a screw head.

4 Claims, 10 Drawing Figures

SCREWDRIVER

The present invention relates generally to improvements in a screwdriver, and more particularly to facilitating the seating of the screw-turning edge in the screw head slot.

Although it is a common, familiar tool, little has been done to elleviate the difficulty sometimes experienced in engaging the screwdriver blade with the screw head slot. Another difficulty, is completing an electrical connection by screwing a small, hard to grasp and hold, screw into threaded engagement with a threaded opening while an electrical conductor or wire is in its coiled relation about the screw and under the screw head.

Broadly, it is an object of the present invention to provide structural features in the screwdriver to overcome the foregoing and other shortcomings of the prior art. More specifically, it is an object to create, at no detraction from the screw-turning function of the tool, an edge that remains clearly in sight and which, as a result, serves as a visual guide for the user for making proper engagement of the screwdriver with the slot of the screw head.

Demonstrating objects and advantages of the present invention are improvements in a screwdriver of the type having a handle and a shank having a longitudinal axis extending forwardly of said handle and terminating at the distal end of the shank in a screw-turning blade, said improvements including a rotation turn in the blade about the longitudinal axis of the shank of about 30 degrees, and wherein at the rotation a portion of the blade is removed as a pair of arcuate cutouts, to thereby contribute to improving the sighting of the user down the longitudinal axis of the shank during use of the screwdriver, said rotational turn and cutouts forming an edge that is always clearly visible and which therefore serves as a positioning guide for the user.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, which consist of two sets of figures which are similar, except that those followed by the letter "A" illustrate the prior art, and those followed by the letter "B" illustrate the inventive embodiment hereof. More particularly, FIGS. 1A and 1B are perspective views illustrating the use of the respective screwdrivers for making an electrical connection;

FIGS. 4A and 4B are side elevational views projected from FIGS. 3A and 3B, and wherein FIG. 4B illustrates the novel rotational turn in said blade end of the within inventive screwdriver.

A common familiar tool, now to be described in connection with FIGS. 1A–5A is a screwdriver 10A, constructed in a well understood manner with a handle 12A and a shank 14A having a longitudinal axis 16A extending forwardly of the handle 12A and terminating at the distal end of the shank in a blade 18A. A screw-turning edge 20A is provided at the end of the blade 18A and in use is inserted in a slot 22A of the head 24A of the screw 26A.

Figure 1A:
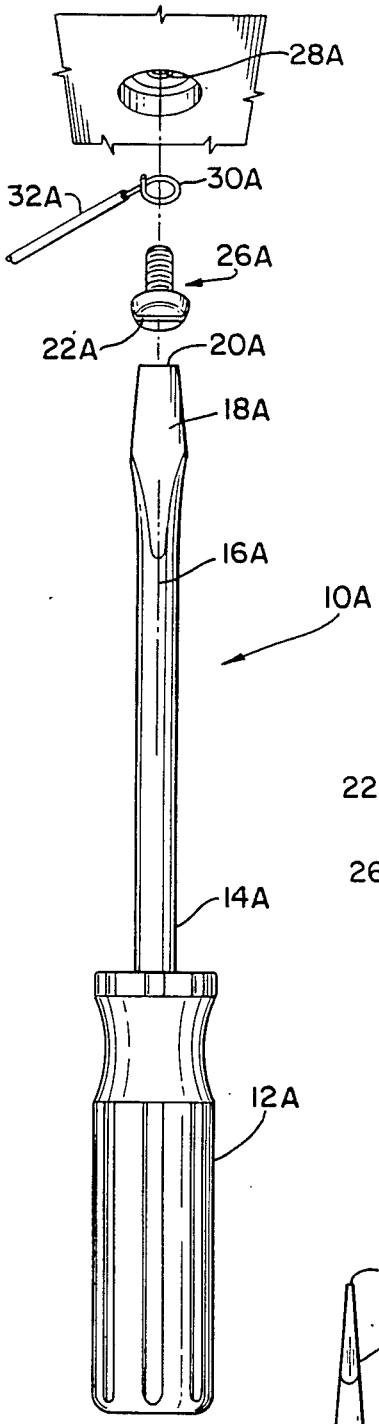
FIG.1A PRIOR ART

As illustrated in FIG. 1A, a typical use of the prior art screwdriver 10A is to threadably engage the screw 26A in a threaded opening 28A with an eyelet 30A of an electrical conductor 2A firmly secured beneath the screw head 24A. This is of course achieved using the screwdriver 10A to threadably engage the screw 6A in the threaded opening 28A.

As is perhaps best illustrated in FIGS. 3A–5A, it is often found in practice that the distal end of the screwdriver shank 14A physically blocks the observance of the user of the screw-turning edge 20A and thereby correspondingly increases the difficulty of inserting the edge 20A in the slot 22A of the screw head. As is perhaps best illustrated in FIG. 5A, the bulk or body specifically designated 14A' in FIG. 5A extends laterally of the edge 20A since said edge is, of course, a narrowing down of the body 14A' into said edge 20A, and as a result prevents the user from actually having observation of the edge 20A during the time that it is attempted to project this edge into the slot 22A of the screw head.

To overcome the aforesaid and other shortcomings of the prior art, improvements now to be specifically described are embodied in the within inventive screwdriver which is illustrated in FIGS. 1B–5B. Since this screwdriver embodies many of the structural features that are conventional in screwdrivers and which therefor have already been described in connection with the prior art screwdriver 10A of FIGS. 1A–5A, these conventional features will not again be described, as not being necessary for an understanding of the invention and will therefor be recognized based on the description already provided, and will be designated by the same reference numbers followed by the letter "B". Moreover, this will also serve to provide a more readily understood comparison between the inventive screwdriver of FIGS. 1B–5B and that of the prior art screwdriver of FIGS. 1A–5A, in that the description which will now follow will be of the structural differences therebetween.

Underlying the present invention is a solution to the problem of enabling the user to maintain observation of the screw-turning edge 20B of the distal end 20B of the blade 18B of the screwdriver 10B during the time that this edge has to be inserted in the slot 22B of the screw head 24B. As will be better understood as the description proceeds, this is achieved by providing an aligning edge at a location adjacent the screw-turning edge 20B, said aligning edge being readily made to stay within the observation of the user. Thus, the user by maintaining observation of the aligning edge, soon to be described, automatically or correspondingly is therefore also provided with a feeling for the location of the screw-turning edge 20B, and thus is able to readily insert this edge in the screw head slot 22B.

Figure 5A:
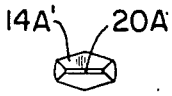
FIG.5A PRIOR ART
FIGS. 5A and 5B are end elevational views of said screwdrivers and wherein FIG. 5B again specifically illustrates the rotational turn in the blade of the within inventive screwdriver.
Figure 5B:
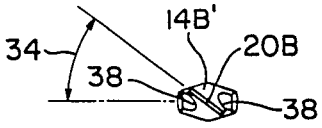
Figure 4A:
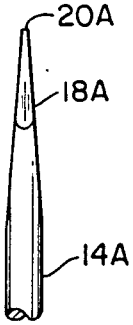
FIG.4A PRIOR ART
Figure 3A:
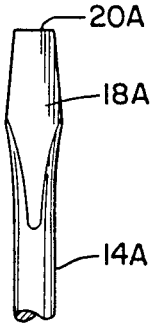
FIG.3A PRIOR ART
FIGS. 3A and 3B are partial plan views illustrating in detail the blade-end of the shanks of said screwdrivers.
Figure 4B:
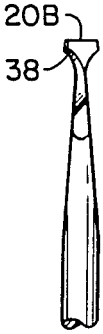
Figure 3B:
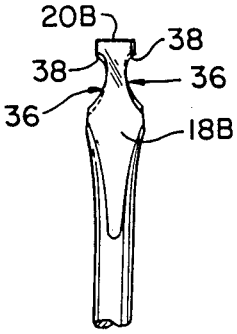

Referring specifically to the drawing FIGS. 1B–5B, it is provided in accordance with the present invention that the blade end 18B of the within inventive screwdriver 10B have a rotational turn about the longitudinal axis 16B of the shank 14B. As best shown in FIG. 5B, this rotational turn, designated simply by the reference numeral 34 without any letter suffix, is, in a preferred embodiment, approximately 37 degrees. As a result of this rotational turn, the screw-turning edge 20B is angularly oriented with respect to the body 14B' of the shank 14B.

In addition to the rotational turn 34, the blade 18B of screwdriver 10B is also provided with opposing cutouts generally designated 36. And as is perhaps best illustrated in FIGS. 3B and 4B, in addition to other functions, the cutouts 36 provide the previously referred to aligning edges 38 which is readily within the observation of the user mainly because of the previously described rotational turn which removes the edge 38 from being blocked by the bulk or body 14B' of the shank.

Figure 2A:
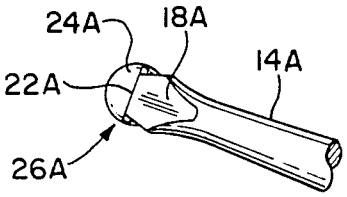
FIG.2A PRIOR ART
FIGS. 2A and 2B are partial perspective views illustrating the screw-turning function of said screwdrivers.
Figure 2B:
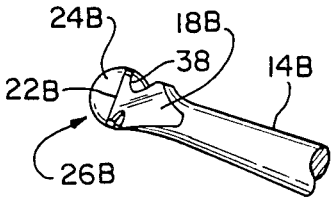

Because of the limitations in making drawings, it is difficult to actually illustrate that each edge 38 is readily in the observation of the user of the screwdriver and that this is because of the rotational turn 34 and, of course, the cutouts 36 which provide said edge 38. But to the extent that this can be illustrated, reference should be made to FIG. 5B which best illustrates how the edges 38 follow a curving path which ultimately ends at the screw-turning edge 20B. In FIG. 5B it also is a point of importance to be noted that each edge 38 is substantially in the same longitudinal plane as the screw-turning edge 20B and that therefore the observation of edge 38 is helpful in obtaining a "feeling" for the location of the edge 20B. Thus, in use, and it has been so observed in practice, the user of the screwdriver by maintaining observation of the edges 38 is provided with a visual guide as to the location of the screw-turning edge 20B which is in general alignment with the edges 38, and that this greatly assists and facilitates projecting the edge 20B into its operative position, as best illustrated in FIG. 2B, in which the screwdriver is able to turn the screw 26B in either clockwise or counter-clockwise rotation by virtue of being in a seated or projected relation within the slot 22B of the screw head 24B.

Figure 1B:
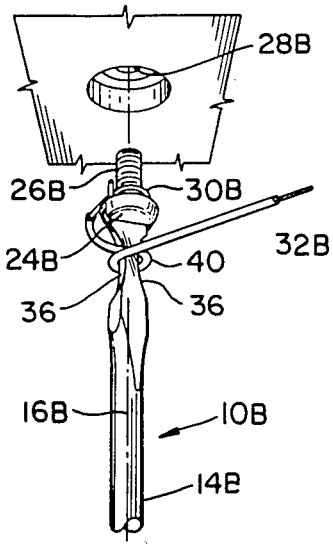

In addition to improving the sighting by the user down the shank of the screwdriver, as just described, the cutouts 36 of the inventive screwdriver 10B also serve another useful function. As best illustrated in FIG. 1B, and constituting a substantial improvement over the situation depicted in FIG. 1A, the screw 26B is adapted to be inserted through the eyelet 30B and the conductor 32B then wound a turn or so, as illustrated at 40, in the cutouts 36, to thereby hold in a tying relation the screw 26B in its operative position at the end of the blade of the screwdriver. Said operative position is one in which the edge 20B is in its inserted or seated position within the slot of the screw head 24B. As a result, the task is greatly facilitated of inserting the screw 26B into threaded engagement within the threaded opening 28B. After this threaded engagement is achieved and the eyelet 30B is therefore firmly secured under the screw head 24B, it is a simple matter to merely undo the turn 40 and detach the conductor 32B from the screwdriver, or this detachment may result automatically since the clockwise turning of the screwdriver unwinds the clockwise turns 40 of the conductor 32B. In the advantageous use in completing the electrical connection for the conductor 32B as just described, the cutouts 36, which are in reality arcuate portions of the shank body that are removed, thus provide a reduced section in the blade of the screwdriver about which the conductor 32B can be wound and from which location the winding 40 will not readily slip. In contrast, the prior art screwdriver 10A has no reduced section and thus does not correspondingly provide any opposing recesses, like the cutouts 36, in which a wire can be coiled for attachment to the screwdriver while having another portion secured to the screw being acted upon, said two points of securement being effective to hold the screw in its operative position in which it has seated in its slot the distal edge of the screwdriver preparatory to being rotated to either threadably engage or disengage the screw from a cooperating threaded opening.

From the foregoing description, it should be readily appreciated that there has been described herein a screwdriver which, due to improved vision, is more readily seated in a screw head slot, as well as having other advantages during use over prior art screwdrivers. Although preferably the rotational turn in the blade of the within inventive screwdriver is 37 degrees, it has been found that favorable results can also be achieved using a screwdriver in which the structural feature is only 30 degrees. In this regard, a latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. Improvements in a screwdriver of the type having a handle and a shank having a longitudinal axis extending forwardly of said handle and terminating at the distal end of said shank in a screw-turning blade having a plane generally parallel to said longitudinal axis of said shank and a screw engaging edge at its end, said improvements comprising along the length of said blade a rotational turn in said blade to offset the portion of said blade distally of said turn from the plane of the blade portion adjacent said shaft, and said rotated blade having in the distal portion a pair of arcuate cutouts, to thereby allow the sighting of the screw engaging edge by the user down the longitudinal axis of said shank during use of said screwdriver; and for engaging a coil of wire for holding a fastener on said blade.

2. An improved screwdriver as claimed in claim 1, wherein said rotational turn of said blade about said longitudinal axis of said shank is at least 30 degrees.

3. A screwdriver for use in securing a screw and the end of a wire in a threaded opening having a handle, a shank having a longitudinal axis extending forwardly of said handle and terminating at the distal end of said shank in a screw-turning blade having a plane generally parallel to said longitudinal axis and a screw engaging edge at its end, said blade having, between said screw engaging edge and said shank, a rotational turn about said longitudinal axis of said shank of at least 30 degrees, to offset the distal end portion of said blade from the plane of the blade portion adjacent said shaft, and said rotated blade having in a location adjacent the end thereof a portion thereof removed as a pair of arcuate cutouts for a wire length coiled about said blade in the cutouts thereof and about the screw to simultaneously hold the screw and the wire for threaded engagement with the threaded opening.

4. A screwdriver comprising a handle and a rigid shank having a longitudinal axis extending forwardly of said handle terminating in an integrally formed screw-turning blade having a plane generally parallel to said longitudinal axis and a screw engaging edge at its end, said blade being turned along its length relative to said longitudinal axis of said shank to offset that portion of said blade adjacent said screw engaging end from the plane of that blade portion adjacent said shaft, and a pair of diametrically opposed arcuate cutouts removed from said blade to permit the sighting of the offset blade portion by the user looking down the longitudinal axis of said shank during use of said screwdriver; and for engaging a coil of wire for holding a fastener on said blade.

* * * * *